US005712604A

United States Patent [19]

Tada et al.

[11] Patent Number: 5,712,604

[45] Date of Patent: Jan. 27, 1998

[54] DIELECTRIC FILTER INCLUDING AT LEAST ONE BAND ELIMINATION FILTER

[75] Inventors: Hitoshi Tada; Hideyuki Kato; Haruo Matsumoto; Tatsuya Tsujiguchi, all of Ishikawa-ken, Japan

[73] Assignee: Murata Manufacturing Co., Ltd., Japan

[21] Appl. No.: 469,443

[22] Filed: Jun. 6, 1995

[30] Foreign Application Priority Data

Sep. 27, 1994 [JP] Japan ..... 6-231829
Sep. 27, 1994 [JP] Japan ..... 6-231830

[51] Int. Cl.[6] ..... H01P 1/20

[52] U.S. Cl. ..... 333/202; 333/203; 333/206

[58] Field of Search ..... 333/202, 203, 333/206, 207, 222, 223

[56] References Cited

U.S. PATENT DOCUMENTS

| | | | |
|---|---|---|---|
| 4,823,098 | 4/1989 | De Muro et al. | 333/202 X |
| 4,983,938 | 1/1991 | Sasaki et al. | 333/207 |
| 5,365,209 | 11/1994 | Ito et al. | 333/202 X |

FOREIGN PATENT DOCUMENTS

| | | | |
|---|---|---|---|
| 0444948 | 3/1991 | European Pat. Off. . | |
| 258502 | 11/1986 | Japan | 333/202 DB |
| 84602 | 4/1987 | Japan | 333/202 DB |

OTHER PUBLICATIONS

Wenzel, Robert; "Recent Trends and Adances in Filters and Couplers" *Microwave Journal;* Jan. 1970; pp. 48–52.
Patent Abstract of Japan, vol. 10, No. 370, 10 Dec. 1986.
Patent Abstract of Japan, vol. 16, No. 469, 29 Sep. 1992.

*Primary Examiner*—Benny Lee
*Attorney, Agent, or Firm*—Majestic, Parsons, Siebert & Hsue P.C.

[57] ABSTRACT

A single-stage dielectric band elimination filter has a dielectric block with its outer surfaces mostly covered by an outer conductor and two mutually coupled resonant lines formed therein. Each resonant line has an open end insulated from the outer conductor and a shorted end connected thereto, the open and shorted ends of the two resonant lines being oppositely oriented. A multi-stage dielectric filter has a plurality of such single-stage band elimination filters formed inside a dielectric block, each mutually adjacent pair of the single-stage band elimination filters being interdigitally coupled or combline-coupled to each other with phase shift of Π/2 therebetween. The open end of a resonant line may be formed at one of the end surfaces of the dielectric block, being connected to an electrode insulated from the outer conductor, or at an annular conductor-free area formed on the inner surface of the corresponding throughhole. The resonant lines for forming the plurality of single-stage band elimination filters may be arranged horizontally or vertically with respect to each other. Screening electrodes may be inserted between mutually adjacent resonant lines.

18 Claims, 14 Drawing Sheets

DIELECTRIC FILTER INCLUDING AT LEAST ONE BAND ELIMINATION FILTER

BACKGROUND OF THE INVENTION

This invention relates to a dielectric band elimination filter. More particularly, this invention relates to a dielectric band elimination filter adapted for use in a mobile communication apparatus such as a portable telephone.

As shown in FIG. 25, and also by an equivalent circuit diagram shown in FIG. 26 (wherein $Z_{in}$ indicates the input impedance), a prior art single-stage dielectric band elimination filter (BEF) is formed with a dielectric resonator 111 and a coupling capacitor 112 connected in series through a connector terminal 113 and having a coupling capacitance value of Ce (see FIG. 26). Its frequency-attenuation characteristic is shown in FIG. 27. FIG. 28 is a block diagram of a prior art mobile communication apparatus such as a portable telephone, with its transmitter side ($T_x$) including an isolator $I_1$, a power amplifier, a band pass filter (BPF) B, and a mixer M1 and its receiver side ($R_x$) including a low noise amplifier, a band pass filter (BPF) and a mixer. A dielectric band elimination filter, as described above, is used in the transmitter circuit inside its duplexer $D_1$. The transmitter frequency $f_{TX}$ and the receiver frequency $f_{RX}$ of this communication apparatus are indicated in the diagram of FIG. 27. It is adjusted such that the receiver frequency $f_{RX}$ and the trap frequency $f_T$ of the dielectric BEF match each other. As another example of prior art technology, a general prior art two-stage dielectric BEF is shown in FIG. 29. In FIG. 29, and FIG. 30 which is its equivalent circuit diagram, R indicates a resonator, $C_e$ indicates a trap capacitor, $C_t$ indicates a parallel capacitor, L indicates an inductor serving as a quarter-wavelength phase shifter, and numerals 121, 122, 123, 124 respectively indicate a case cover, a connector terminal, an inductor pattern substrate, and a common substrate as depicted in FIG. 29. FIG. 31 Shows the frequency-attenuation characteristic of this dielectric BEF, and also indicates the transmitter frequency $f_{TX}$ and the receiver frequency $f_{RX}$ when this filter is used in the transmitter side of the duplexer $D_1$ of the communication apparatus shown in FIG. 28. In this application, too, the receiver frequency $f_{RX}$ and the trap frequency $f_T$ of the filter are adjusted to match each other.

With prior art mobile communication apparatus as described above, waves with frequency $f_s=f_{TX}-(f_{RX}-f_{TX})$ entering from the antenna $A_1$ (see FIG. 28) into the transmitter side of the duplexer $D_1$ cannot be stopped by a dielectric BEF with attenuation characteristic as given in FIG. 27 or FIG. 31 alone. This is why an isolator $I_1$ is inserted into the transmitter circuit as shown in FIG. 28. In addition, a band pass filter (BPF) $B_1$ is required in the transmitter circuit in order to attenuate waves with unwanted frequencies generated in the mixer $M_1$ on the transmitter side.

Problems of this kind would not occur if a dielectric BPF were used in the place of the dielectric BEF in the transmitter circuit of the duplexer $D_1$, but there would arise a different problem that insertion loss and attenuation characteristics obtainable by a dielectric BEF cannot be fully realized by a filter of a comparable size. In order to form a single-stage dielectric BEF as described above, furthermore, not only a dielectric resonator but also a coupling capacitor and a connector terminal for connecting the dielectric resonator and the coupling capacitor would be needed. Similarly, in order to form a two-stage dielectric BEF as described above, not only a dielectric resonator but also extra component parts such as a case cover, connector terminals, an inductor pattern substrate and a common substrate would be needed. In short, the number of required component parts and cost would increase, and the apparatus would become bulkier.

It is therefore an object of this invention to eliminate the problems described above and to provide dielectric BEFs which are capable of simplifying the circuit structure of mobile communication apparatus such as portable telephones, having only a small number of component parts and being compact in size.

SUMMARY OF THE INVENTION

A single-stage dielectric band elimination filter embodying this invention, with which the above and other objects can be accomplished, may be characterized as comprising a dielectric block having its outer surfaces mostly covered by an outer conductor and two mutually coupled resonant lines formed therein, each having an open end which is insulated from the outer conductor and a shorted end which is connected to the outer conductor, and the open and shorted ends of the two resonant lines being oppositely oriented. The resonant lines are formed by providing inner conductors on the inner surfaces of throughholes formed through the block. The open ends of the resonant lines may be at end surfaces of the block where the throughholes open or at conductor-free portions of the inner surfaces of the throughholes.

A multi-stage dielectric filter embodying this invention may be characterized as having a plurality of single-stage band elimination filters formed inside a dielectric block, each of these single-stage filters being formed with an interdigitally coupled pair of resonant lines, each mutually adjacent pair of the single-stage band elimination filters being inter-digitally coupled or combline-coupled to each other with phase shift of Π/2 therebetween.

Each single-stage band elimination filter may be structured as described above, each of its two resonant lines having an open end and a shorted end, and their open and shorted ends being oriented oppositely. Each open end may be formed at one of the end surfaces of the dielectric block, being connected to an electrode on the end surface and insulated from the outer conductor, or at an annular conductor-free area formed on the inner surface of the corresponding throughhole.

The resonant lines for forming the plurality of single-stage band elimination filters may be arranged in various ways. They may be arranged in two horizontal rows (the upper and lower rows) and many vertical columns, those on the upper and lower rows in each column forming a single-stage filter. With this arrangement of the resonant lines, all of the resonant lines on the upper row may be arranged to have their open ends pointing towards one of the end surfaces of the dielectric block, those on the lower row pointing to the other end surface. Alternatively, the resonant lines may be so arranged that the open ends of two mutually adjacent resonant lines on the same row are always oriented in opposite directions. Screening electrodes may be inserted between resonant lines which are next to each other on the same row.

The pairs of resonant lines forming single-stage band elimination filters need not all be arranged in the same direction. Two such filters with horizontally arranged resonant line may sandwich one with vertically arranged resonant line inside a horizontally elongated dielectric block with an upwardly protruding center part for forming therein one of the resonant lines for the vertically arranged filter.

The throughholes for containing the resonant lines may have a flattened shape such that the dielectric block can be made thinner.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, the same or equivalent components and concepts are indicated by the same symbols and may not be repetitiously described what they are with respect to each of the figures in which they appear.

DETAILED DESCRIPTION OF THE INVENTION

Figure 1:
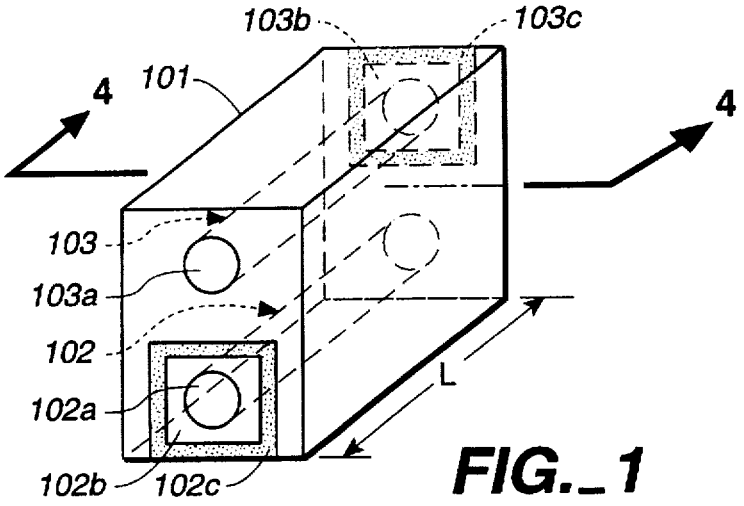
FIG. 1 is a schematic diagonal view of a single-stage dielectric BEF according to a first embodiment of this invention.

FIG. 1 shows a single-stage dielectric BEF according to a first embodiment of this invention, formed by a combination of two resonant lines. A rectangular dielectric block 101 has two circular cylindrical throughholes 102*a*, 103*a* formed near each other from one end surface to the opposite end surface. Inner conductors are formed on the inner surfaces of the throughholes 102*a*, 103*a*. The inner conductor inside throughhole 102*a* is connected to a rectangular electrode 102*b* on one of the end surfaces (first end surface) of the dielectric block 101. The inner conductor inside throughhole 103*a* is connected to another rectangular electrode 103*b* on the other end surface (second end surface) of the dielectric block 101. The outer surfaces of the dielectric block 101 are substantially entirely covered by an outer conductor, excluding conductor-free (or dielectric-exposing) areas 102*c*, 103*c* surrounding the electrodes 102*b*, 103*b*. The inner conductor inside throughhole 102*a* is connected to the outer conductor on the second end surface of the dielectric block 101 to form a quarter-wavelength resonant line 102. The inner conductor inside throughhole 103*a* is connected to the outer conductor on the first end surface of the dielectric block 101 to form another quarter-wavelength resonant line 103. The conductor-free areas 102*c*, 103*c* serve as open ends of these quarter-wavelength resonant lines 102, 103. It is to be noted that these two resonant lines 102, 103 are in a point-symmetric relationship with respect to the dielectric block 101.

Figure 2:
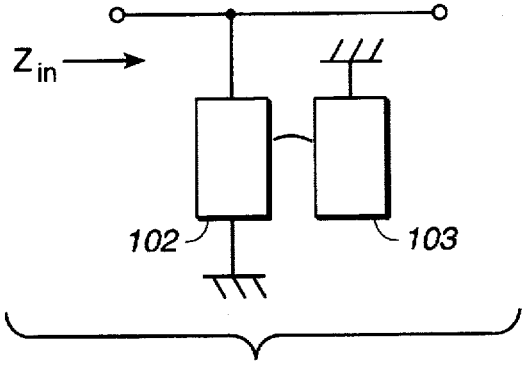
FIG. 2 is a circuit structure diagram of the filter of FIG. 1.
Figure 3:
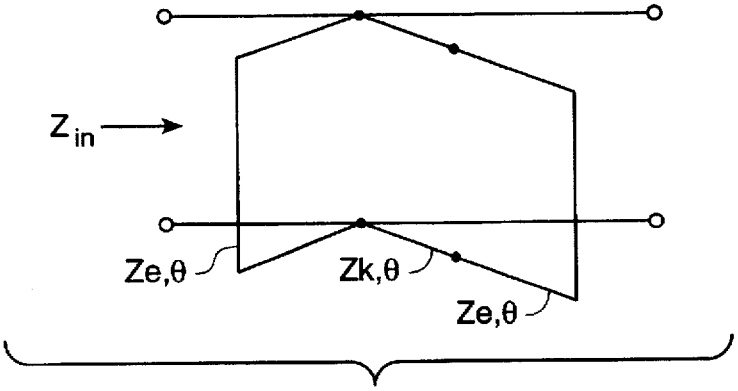
FIG. 3 is an equivalent circuit diagram of the filter of FIG. 1.
Figure 4:
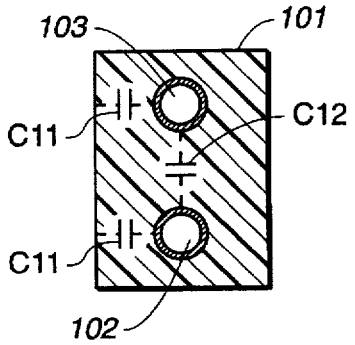
FIG. 4 is a sectional view of the filter of FIG. 1 taken along line 4—4 in FIG. 1 for explaining equivalent capacitances.

FIG. 2 shows the circuit structure of the filter described above connected to a communication line between an input terminal and an output terminal, its equivalent circuit diagram being shown in FIG. 3, and FIG. 4 is a sectional view of the filter taken along line 4—4 in FIG. 1 to show how equivalent capacitors are formed. As indicated in FIG. 4, self-capacitance $C_{11}$ per unit length is formed between each of the resonant lines 102, 103 and the outer conductor, and mutual capacitance $C_{12}$ is formed between the two resonant lines 101, 103. In FIGS. 2 and 3, $Z_{in}$ indicates the input impedance. In FIG. 3, $Z_e$ and $Z_o$ respectively indicate the even-mode and odd-mode characteristic impedance give by:

$$Z_e=\sqrt{\epsilon_r}/v_c C_{11},$$

$$Z_o=\sqrt{\epsilon_r}/v_c(C_{11}+2C_{12}),$$

where $\epsilon_r$ is the specific dielectric constant and $v_c$ is the speed of light. The coupling characteristic impedance $Z_k$ is defined as:

$$\begin{aligned} Z_k &= 2Z_eZ_o/(Z_e-Z_o) \\ &= \sqrt{\epsilon_r}/v_c C_{12}. \end{aligned}$$

The phase angle θ is given by:

$$\theta=\omega\sqrt{\epsilon_r}\cdot L/v_c,$$

where ω indicates the angular frequency (or ω=2Πf where f is the frequency), and L indicates the length of each resonant line.

In FIG. 3, the equivalent circuit diagram shows a parallel connection of the even-mode characteristic impedance $Z_e$ and a series connection of the coupling characteristic impedance $Z_k$ and the even-mode characteristic impedance $Z_e$ between the input (output) and the ground.

Figure 5:
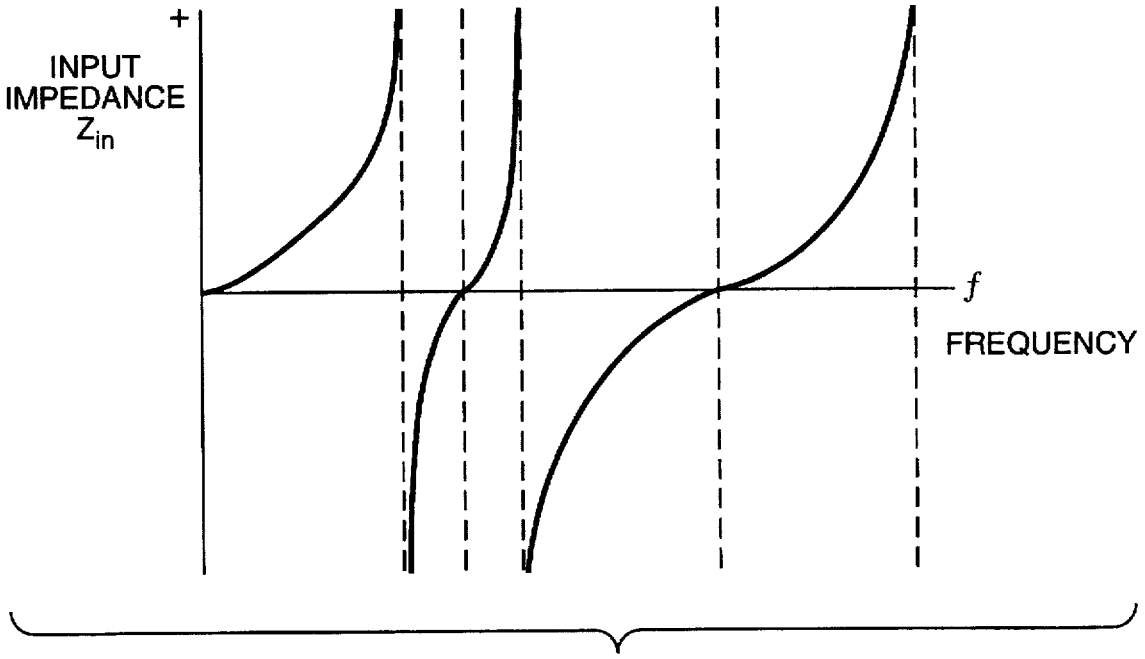
FIG. 5 is a diagram showing the input impedance characteristic of the filter of FIG. 1.
Figure 6:
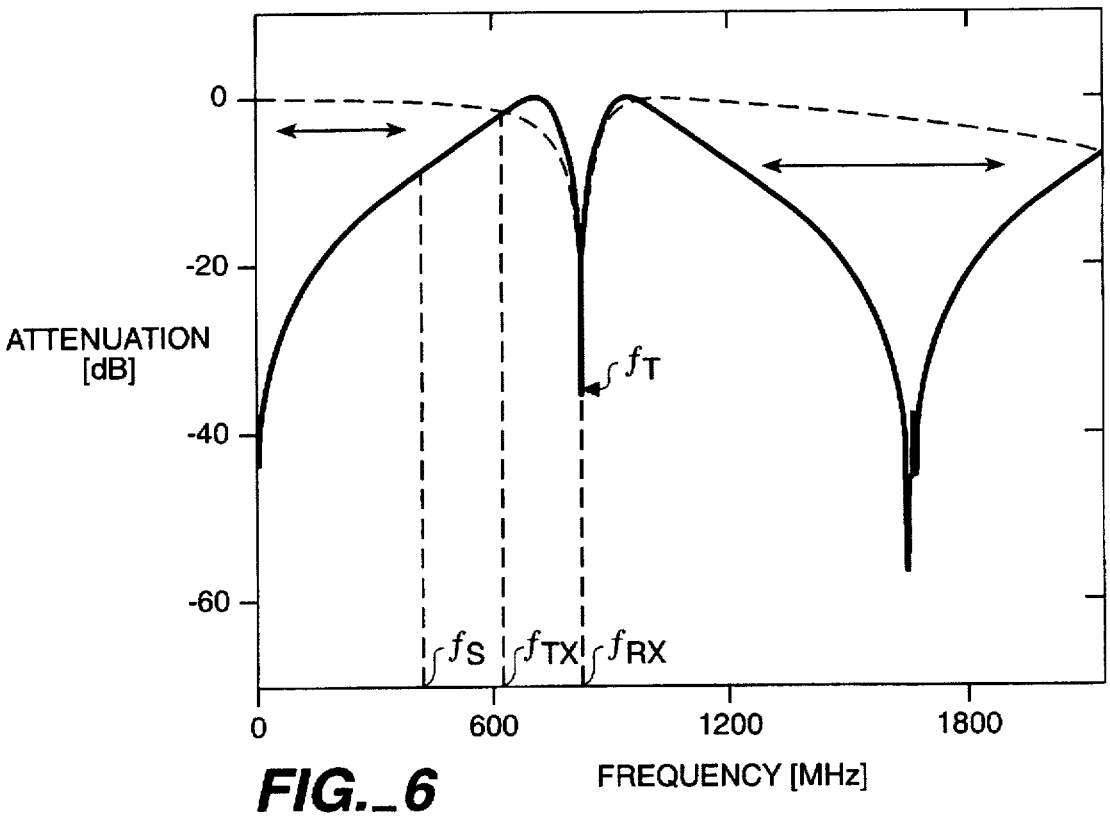
FIG. 6 is a frequency-attenuation characteristic of the filter of FIG. 1.

FIG. 5 shows the input impedance characteristic of this filter, and FIG. 6 shows its frequency-attenuation characteristic. As shown in FIG. 5, the input impedance increased with frequency and reaches infinity, giving rise to the first peak shown in FIG. 6 on the lower-frequency side of the lower attenuation pole which corresponds to the first zero of the curve in FIG. 5. The next infinity point in FIG. 5 gives rise to the second peak shown in FIG. 6 on the higher-frequency side of the attenuation pole. The next zero on the curve of FIG. 5 corresponds to the higher-frequency attenuation pole shown in FIG. 6. In FIG. 6, the trap frequency $f_T$ is given by:

$$f_T=v_c/4\sqrt{\epsilon_r}\cdot L.$$

Figure 27:
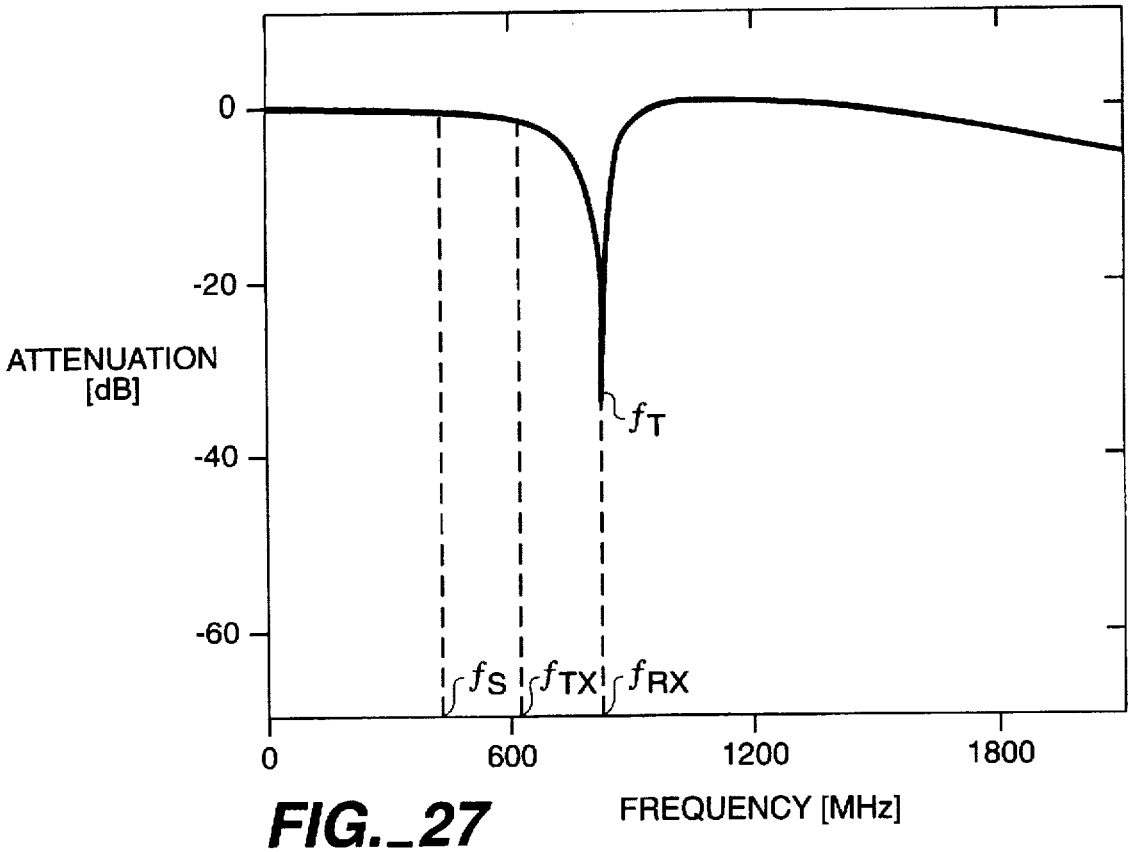
FIG. 27 (PRIOR ART)
FIG. 27 is a frequency-attenuation characteristic diagram of the prior art filter of FIG. 25.

In FIG. 6, the solid line is for this invention; the broken line is for a prior art example shown in FIG. 27. FIG. 6 shows that increased attenuation is obtained by the present invention both in regions (indicated by double-headed arrows) on the higher frequency and lower frequency sides of the trap frequency.

Figure 28:
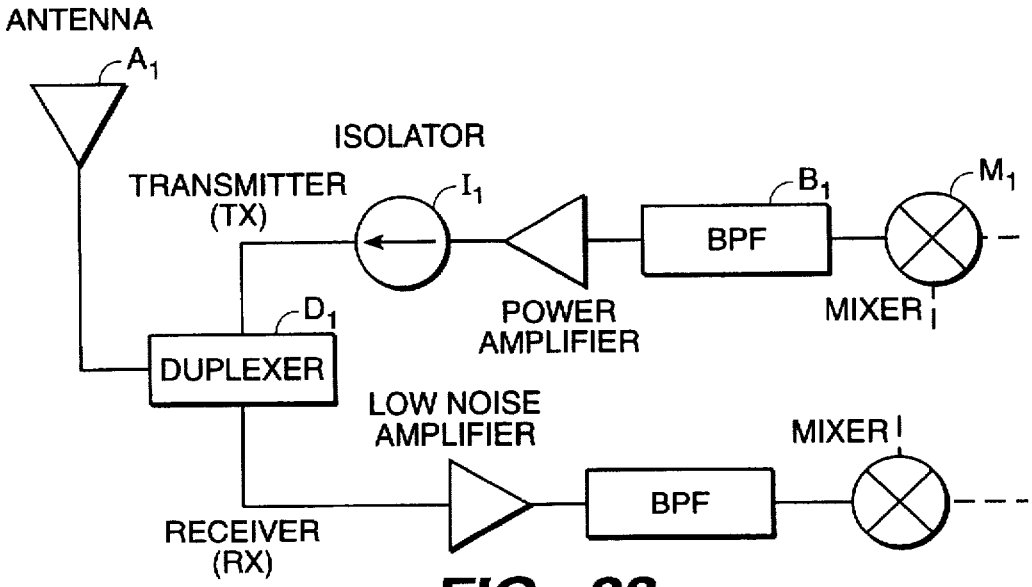
FIG. 28 (PRIOR ART)
FIG. 28 is a block circuit diagram of a mobile communication apparatus such as a portable telephone, using a prior art dielectric BEF.

If a single-stage dielectric BEF according to this invention having such a frequency-attenuation characteristic is used in the transmitter circuit of the duplexer $D_1$ of the mobile communication apparatus shown in FIG. 28, it becomes possible to eliminate the isolator $I_1$ for preventing unwanted waves from passing through the antenna $A_1$ into the transmitter side of the duplexer $D_1$ because sufficient attenuation is obtained on the lower frequency side of the trap frequency. Since attenuation is obtained both on the lower and higher frequency sides of the trap frequency, furthermore, the BPF $B_1$ for attenuating waves with unwanted frequencies generated by the mixer $M_1$ on the transmitter side can be either eliminated or replaced by a smaller, less costly BPF with fewer stages. Moreover, since the dielectric BEF according to this invention is formed with a single dielectric block providing its trap circuit by a mutually coupling pair of resonant lines, there is no need for a coupling capacitor to be connected or any connector terminal. In other words, the number of component parts can be reduced.

Figure 7:
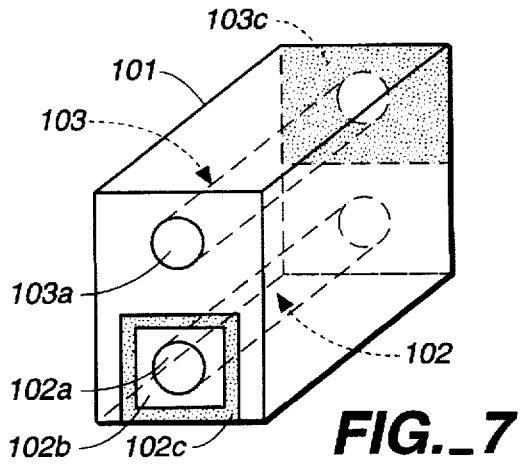
FIG. 7 is a schematic diagonal view of another single-stage dielectric BEF according to a second embodiment of this invention.

FIG. 7 shows another single-stage dielectric BEF according to a second embodiment of this invention, which is similar to the one described above except that the electrodes 103*b* for resonant line 103 and the outer conductor are removed from the second end surface. Components which are substantially identical or function substantially identically to those of the filter shown in FIG. 1 are indicated by the same numerals and are not repetitively described below.

The filter according to the second embodiment shown in FIG. 7 functions substantially like the first embodiment and is advantageous in that the number of electrode patterns is reduced and hence that it can be produced at a reduced cost.

Figure 8:
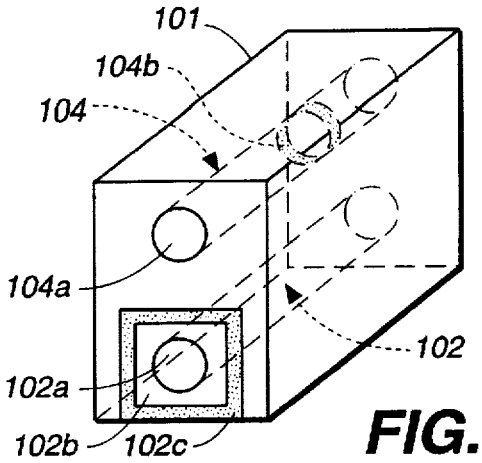
FIG. 8 is a schematic diagonal view of still another single-stage dielectric BEF according to a third embodiment of this invention.

FIG. 8 shows still another single-stage dielectric BEF according to a third embodiment of this invention, which is similar to the first embodiment described above with reference to FIG. 1 and of which components substantially identical or at least similar to those of the first embodiment are indicated in FIG. 8 by the same numerals. The third embodiment is different from the first embodiment in that two inner conductors (first and second inner conductors) are formed inside one of the throughholes (104*a*). One end of the first inner conductor is connected to the outer conductor on the first end surface of the dielectric block 101. One end of the second inner conductor is connected to the outer conductor on the second end surface of the dielectric block 101. Between the other ends of the two inner conductors, there is an annular conductor-free (or dielectric-exposing) area 104*b* formed on the inner surface of the throughhole 104*a* near the second end surface. The longer one of the inner conductors (or the first inner conductor in FIG. 8) serves as the resonant line 104, having its open end inside the throughhole 103*a*.

Although not separately illustrated in a figure, the conductor-free area 104*b* may be formed adjacent to the second end surface (there being no second inner conductor), as a variation of the third embodiment.

A single-stage filter according to the third embodiment of the invention also has functions similar to the first embodiment and is advantageous wherein it has better shielding effects because the outer surfaces of the dielectric block 1 are completely covered by the outer conductor except at the input and output portions.

Figure 9:
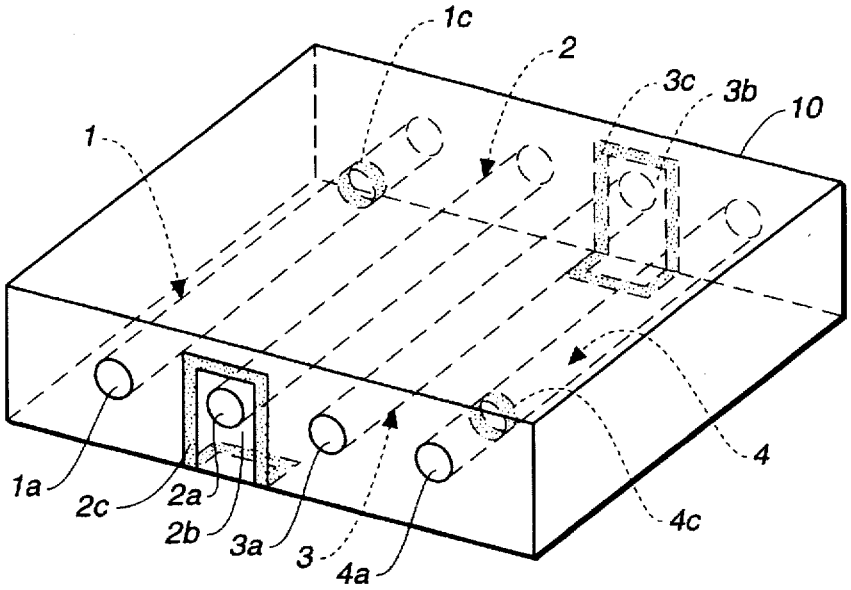
FIG. 9 is a schematic diagonal view of a two-stage dielectric BEF according to a fourth embodiment of this invention.

FIG. 9 shows a two-stage dielectric BEF according to a fourth embodiment of this invention, comprising a rectangular dielectric block 10 having four circular cylindrical throughholes 1*a*, 2*a*, 3*a*, 4*a* formed therethrough near one another from one end surface to the opposite end surface of the block 10. Inner conductors are formed on the inner surfaces of the throughholes 1*a*, 2*a*, 3*a*, 4*a*. The inner conductor inside throughhole 2*a* is connected to an electrode 2*b* on one of the end surfaces (first end surface) of the block 10. The inner conductor inside throughhole 3*a* is connected to another electrode 3*b* on the other end surface (second end surface) of the block 10. The outer surfaces of the block 10 are substantially entirely covered by an outer conductor except conductor-free (or dielectric-exposing) areas 2*c*, 3*c* surrounding the electrodes 2*b*, 3*b*, respectively.

Inside throughhole 1*a*, an annular conductor-free (or dielectric-exposing) area 1*c* is formed on the inner surface near the second end surface. Inside throughhole 4*a*, another annular conductor-free (or dielectric-exposing) area 4*c* is formed on the inner surface near the first end surface. The inner conductors inside throughholes 1*a*, 3*a*, 4*a* are connected to the outer conductor on the first end surface, and the inner conductors inside throughholes 1*a*, 2*a*, 4*a* are connected to the outer conductor on the second end surface such that interdigital resonator lines 1, 2, 3 and 4 are formed by these throughholes 1*a*, 2*a*, 3*a* and 4*a* respectively. It is to be noted that the conductor-free areas 1*c*, 2*c*, 3*c*, 4*c* serve as open ends of the resonant lines 1, 2, 3 and 4 respectively.

Although not separately illustrated in figures, the annular conductor-free areas 1*c*, 4*c* may be formed adjacent respectively to the second end surface and to the first end surface of the block 10, as discussed with reference to the filter according to the third embodiment of the invention shown in FIG. 8.

Figure 10:
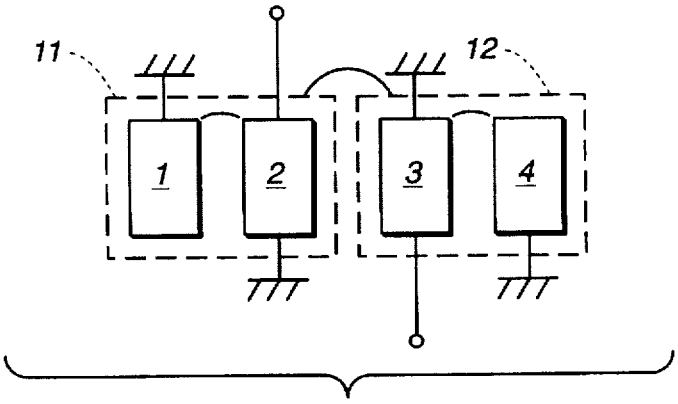
FIG. 10 is a circuit structure diagram of the filter of FIG. 9.
Figure 11:
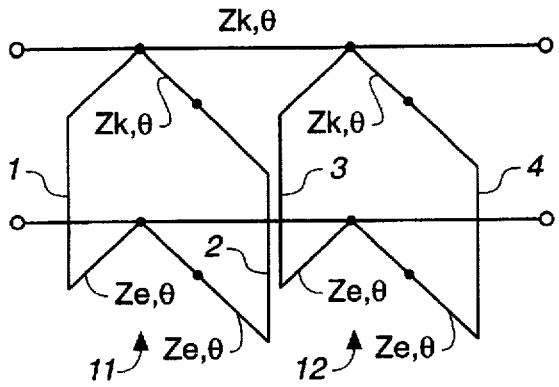
FIG. 11 is an equivalent circuit diagram of the filter of FIG. 9.

As shown in FIG. 10, which is a circuit structure diagram of the filter shown in FIG. 9, resonant lines 1, 2 couple to each other interdigitally to together form a one-stage BEF 11, and resonant lines 3, 4 similarly couple to each other interdigitally to together form another single-stage BEF 12. These two BEFs 11, 12 are coupled to each other through a quarter-wavelength phase shifter formed between the resonant lines 2, 3 such that a two-stage dielectric BEF is formed as a whole. A dielectric BEF thus formed is capable of providing attenuation on both higher and lower frequency sides of the trap frequency, the electrodes 2b, 3b of the resonant lines 2, 3 serving as input and output lines as seen in FIG. 9. In FIG. 11, which is an equivalent circuit diagram of the filter of FIG. 9, $Z_e$, $Z_k$ and θ again indicate the even-mode characteristic impedance, coupling characteristic impedance and phase shift angle of Π/2, respectively. Each single-stage BEF 11, 12 is represented as a parallel connection of a series-connected parallel branch comprising ($Z_k$, θ) and ($Z_e$, θ) and another parallel branch comprising ($Z_e$, θ). The filter shown in FIG. 9 is represented as a combination of two such single-stage BEFs connected through transmission lines $Z_k$, θ).

Figure 12:
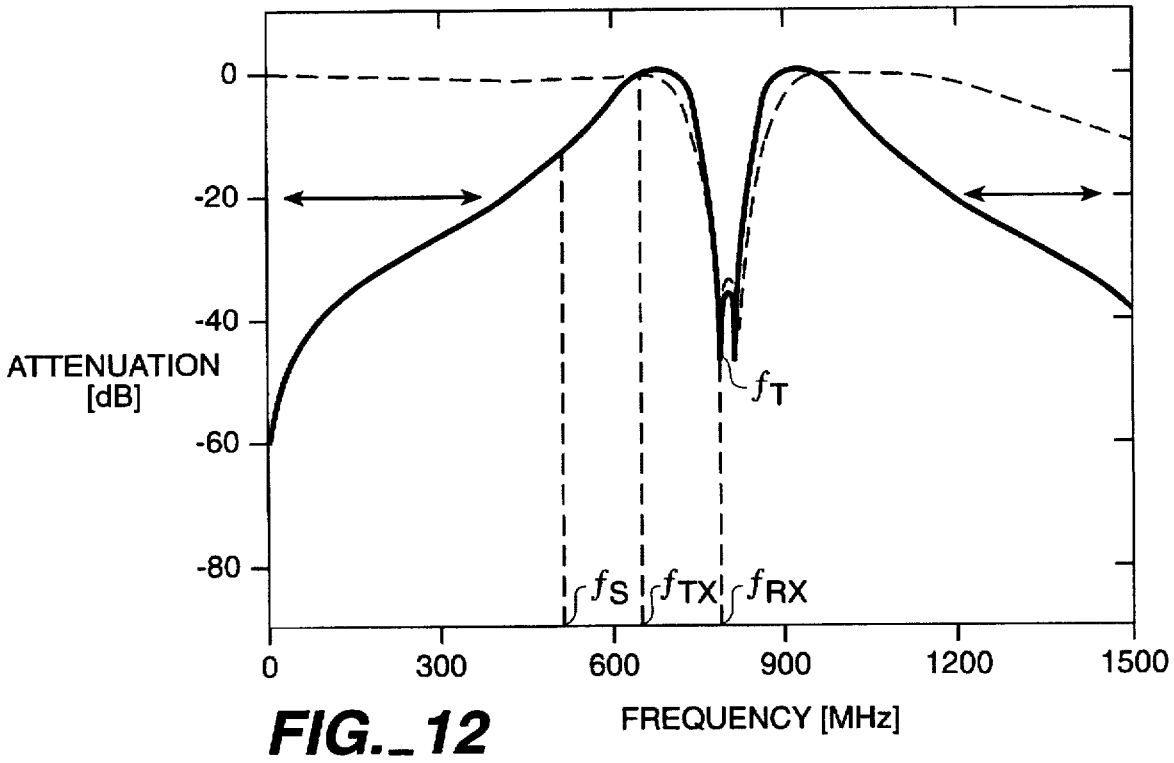
FIG. 12 is a frequency-attenuation characteristic diagram for the filter of FIG. 9 and a prior art filter.
Figure 31:
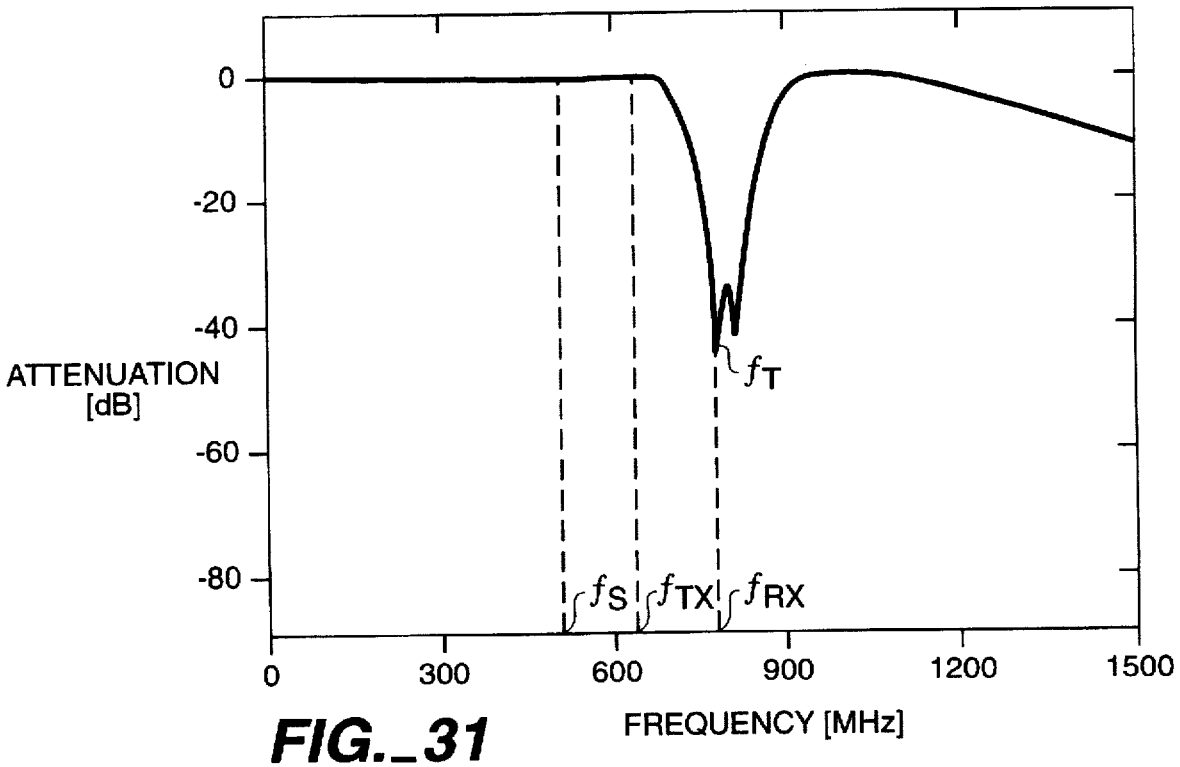
FIG. 31 (PRIOR ART)
FIG. 31 is a frequency-attenuation characteristic diagram of the prior art filter of FIG. 29.

In the frequency-attenuation characteristic diagram of FIG. 12, the solid line is for the filter described above, the broken line is for a prior art filter represented by FIG. 31. FIG. 12 shows that attenuation at the trap frequency $f_T$ is approximately the same but that increased attenuation is obtained by the present invention both on lower and higher frequency regions (shown by arrows) with respect to the trap frequency $f_T$.

Figure 29:
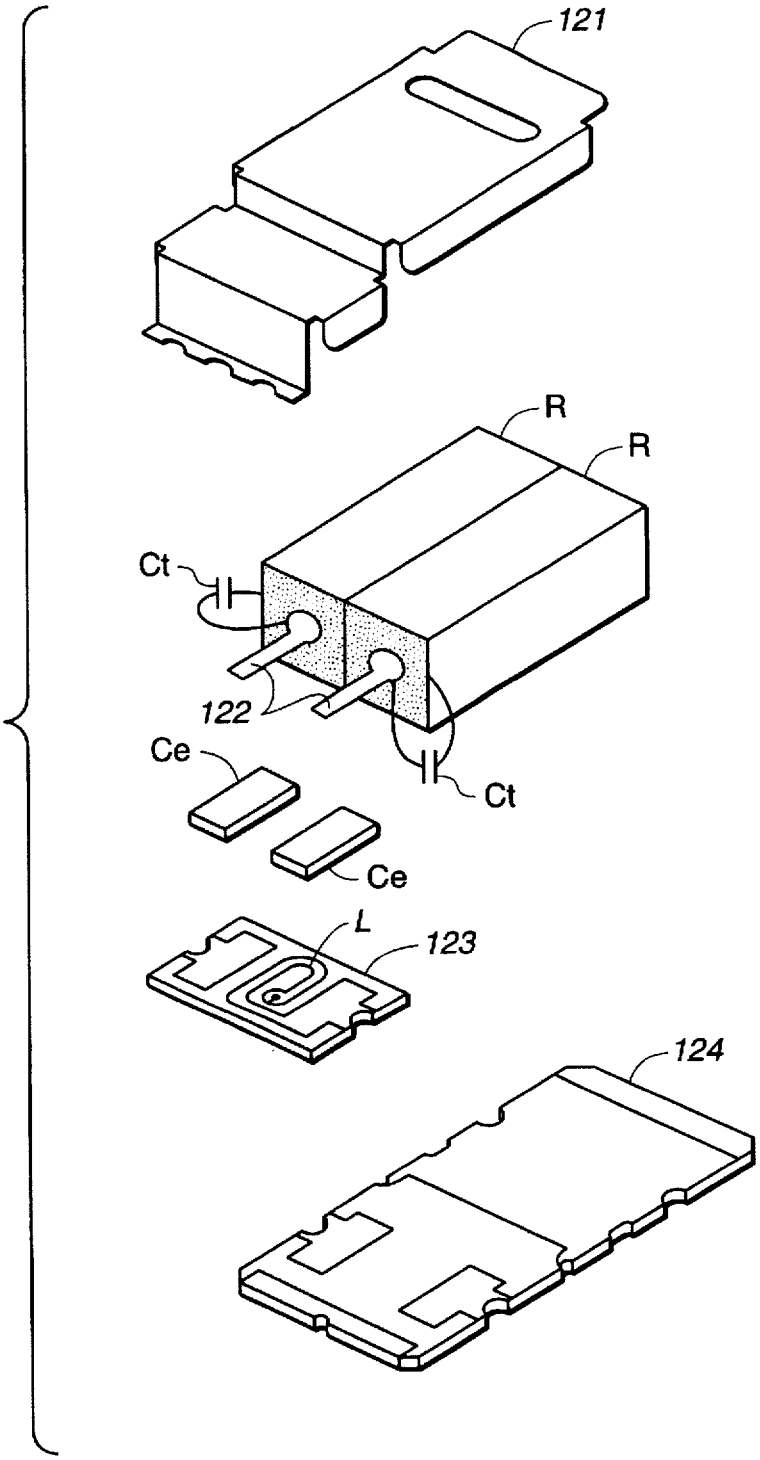
FIG. 29 (PRIOR ART)
FIG. 29 is an exploded diagonal view of another prior art dielectric BEF.
Figure 30:
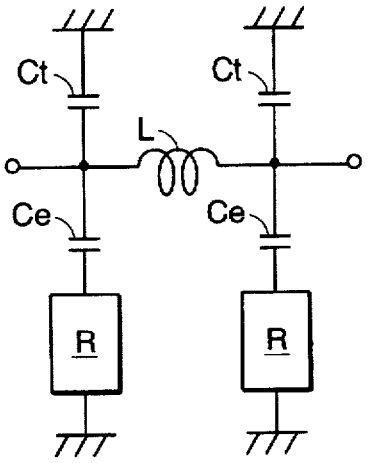
FIG. 30 (PRIOR ART)
FIG. 30 is a circuit structure diagram of a general prior art dielectric filter.

In the prior art example shown in FIG. 29, an LC-type Π-circuit is adapted to serve both as a quarter-wavelength phase shifter and a low pass filter for obtaining attenuation outside the band. With an LC-type low pass filter, however, attenuation cannot be obtained on the lower frequency side, and attenuation on the higher frequency side is not sufficiently great, as compared to what is achievable by the present invention.

If a two-stage dielectric BEF having such frequency-attenuation characteristic is used in the transmitter circuit in the duplexer $D_1$ of the mobile communication apparatus shown in FIG. 28, it is possible to eliminate the isolator $I_1$ for preventing unwanted waves from passing through the antenna $A_1$ into the transmitter side of the duplexer $D_1$ because sufficient attenuation is obtained on the lower frequency side of the trap frequency. Since attenuation is obtained in fact both on the lower and higher frequency sides of the trap frequency, the BPF $B_1$ for attenuating waves of unwanted frequencies generated by the mixer $M_1$ on the transmitter side can be either eliminated or replaced by a smaller, less costly BPF with fewer stages.

Figure 13:
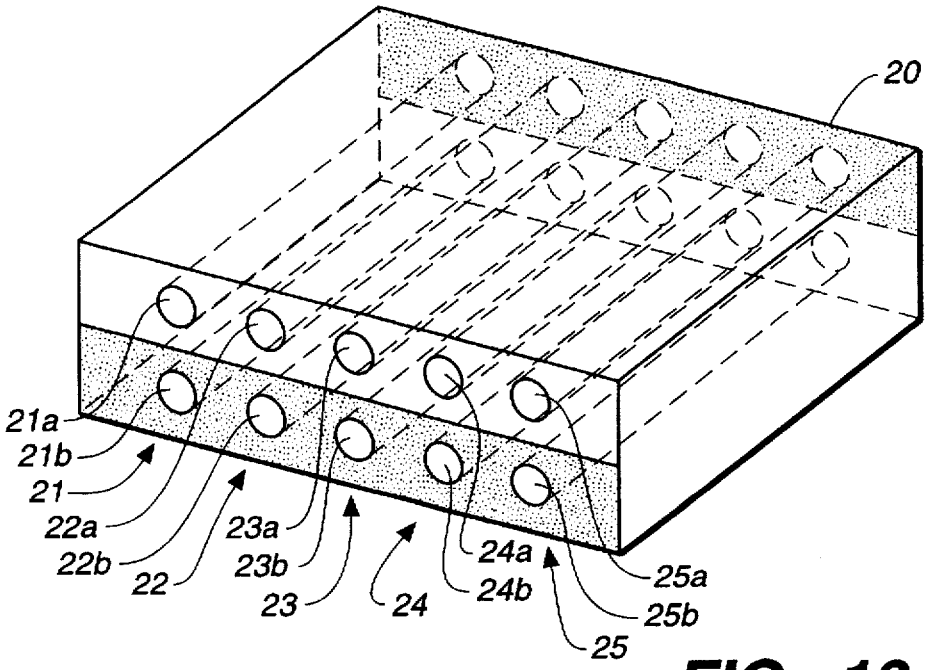
FIG. 13 is a schematic diagonal view of a five-stage dielectric BEF according to a fifth embodiment of this invention.

FIG. 13 shows a five-stage combline-coupled dielectric BEF according to a fifth embodiment of this invention, comprising a rectangular dielectric block 20 having a total of ten circular cylindrical throughholes formed therethrough near one another from one end surface to the opposite end surface of the block 20, arranged geometrically in two horizontal rows such that resonant lines 21a–25a are formed in the five throughholes of the upper row and resonant lines 21b, 22b, 23b, 24b and 25b are formed in the five throughholes of the lower row.

On one of the end surfaces (first end surface) of the dielectric block 20, the resonant lines 21a–25a of the upper row each have a shorted end and the resonant lines 21b–25b of the lower row each have an open end. On the opposite end surface (second end surface) of the block 20, the resonant lines 21a–25a of the upper row each have an open end and the resonant lines 21b–25b of the lower row each have a shorted end. The outer surfaces of the dielectric block 20 are substantially entirely covered by an outer conductor excluding the open end surfaces. Inner conductors are formed on the inner surfaces of the throughholes forming the resonant lines 21a–25a, 21b–25b.

Figure 14:
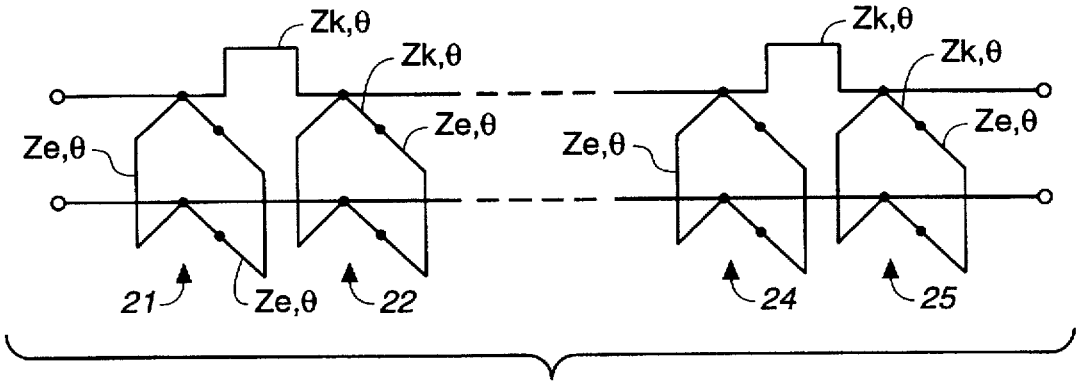
FIG. 14 is an equivalent circuit diagram of the filter of FIG. 13.

Each of pairs of upper-row and lower-row resonant lines 21a with 21b, 22a with 22b, 23a with 23b, 24a with 24b, 25a with 25b couples interdigitally to form one-stage BEFs 21, 22, 23, 24, 25. Each mutually adjacent pair of these one-stage BEFS is combline-coupled to each other according to a known mechanism. Input to and output from this dielectric filter are effected through the resonant lines 21b and 25b. An equivalent circuit diagram of this filter is shown in FIG. 14, showing single-stage BPFs, each represented as a parallel connection of a series-connected branch with ($Z_e$, θ) and ($Z_k$, θ) and another branch ($Z_e$, θ), connected through shorted transmission lines ($Z_k$, θ).

Figure 15:
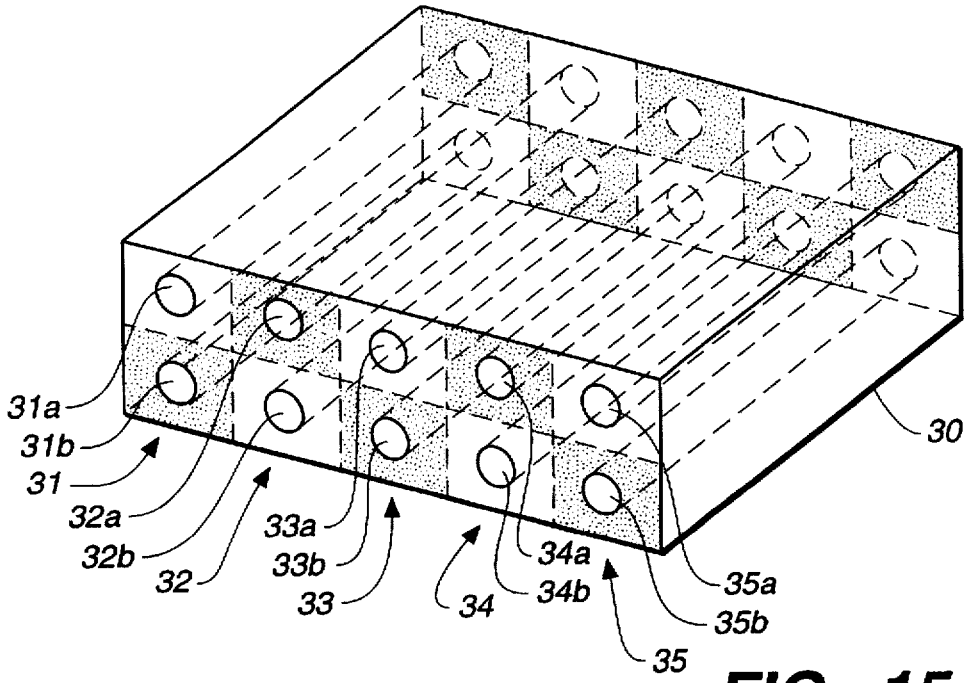
FIG. 15 is a schematic diagonal view of another five-stage dielectric BEF according to a sixth embodiment of this invention.

FIG. 15 shows a five-stage interdigitally coupled dielectric BEF according to a sixth embodiment of this invention, comprising a rectangular dielectric block 30 having a total of ten circular cylindrical throughholes formed therethrough near one another from one end surface to the opposite end surface of the block 30, arranged geometrically in two horizontal rows, resonant lines 31a, 32a, 33a, 34a and 35a being formed in the five throughholes of the upper row and resonant lines 31b–35b being formed in the five throughholes of the lower row. Inner conductors are formed on the inner surfaces of these ten throughholes for the resonant lines 31a–35a, 31b–35b.

Figure 16:
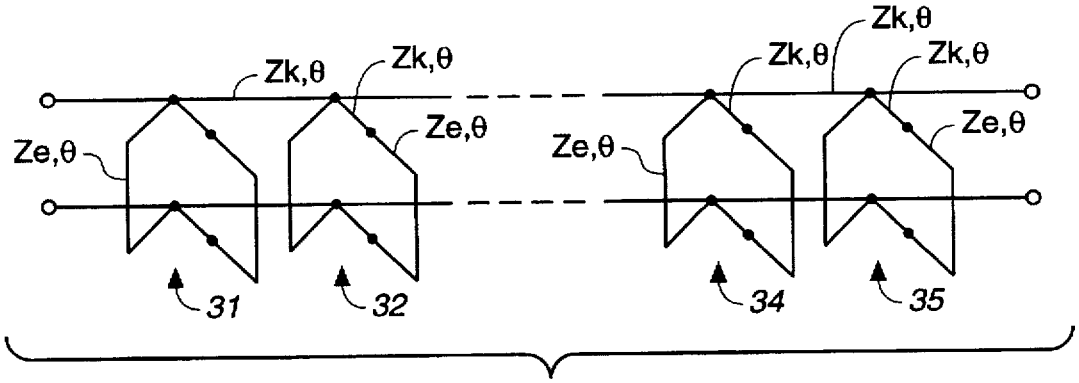
FIG. 16 is an equivalent circuit diagram of the filter of FIG. 15.

Resonant lines 31a, 32b, 33a, 34b, 35a each have a shorted end on one of the end surfaces (first end surface) of the dielectric block 30 and an open end on the other end surface (second end surface). Resonant lines 31b, 32a, 33b, 34a, 35b each have an open end on the first end surface and a shorted end on the second end surface. The outer surfaces of the dielectric block 30 are substantially entirely covered by an outer conductor except at the aforementioned open ends. Each of the pairs of upper and lower resonant lines 31a with 31b, 32a with 32b, 33a with 33b, 34a with 34b, 35a with 35b couples to each other interdigitally to form a single-stage BEF 31, 32, 33, 34, 35. Each mutually adjacent pair of these one-stage BEFs is interdigitally coupled, as shown in the equivalent circuit diagram of FIG. 16. Since this equivalent circuit diagram is similar to the one explained above in FIG. 11, it is not repetitively explained here. Input to and output from this filter are effected through resonant lines 31b and 35b as depicted in FIG. 15. It is to be noted that the resonant lines 1, 2, 3 and 4 of FIG. 9 correspond respectively to resonant lines 31a, 31b, 35b and 35a of FIG. 15. While the filter of FIG. 9 is of a two-stage type, that of FIG. 15 has five stages with three intermediate BEFs 32, 33 and 34. While the two resonant lines for each BEF are horizontally disposed with respect to each other in the filter of FIG. 9, those for each BEF of FIG. 16 are vertically separated with respect to each other. Since the only different between FIGS. 9 and 15 are the number of stages and the relative orientation of resonant lines for each BEF, the equivalent circuit shown in FIG. 16 can be explained similarly to that shown in FIG. 9.

Figure 17:
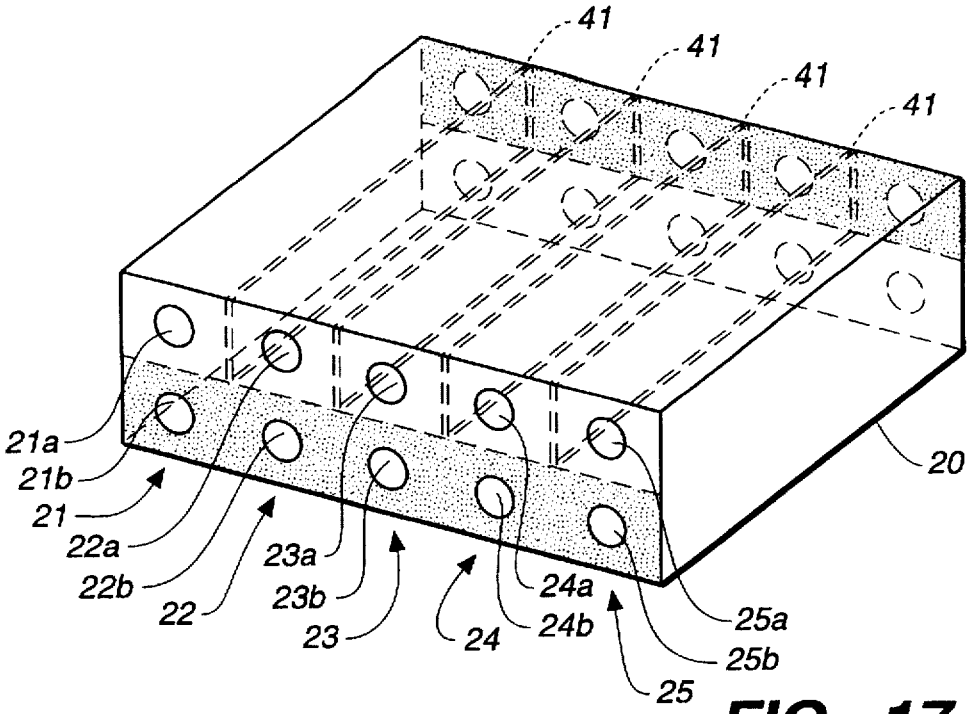
FIG. 17 is a schematic diagonal view of still another five-stage dielectric BEF according to a seventh embodiment of this invention.

FIG. 17 shows another five-stage combline-coupled dielectric BEF according to a seventh embodiment of this invention. This filter is similar to the one described above with reference to FIG. 13 except that screening electrodes 41 connected to the outer conductor are provided between each mutually adjacent pair of the resonant lines 21*a*, 22*a*, 23*a*, 24*a* and 25*a* of the upper row. In all other aspects, this filter is identical to the one shown in FIG. 13. Therefore, same numerals as used in FIG. 13 are used in FIG. 17 to indicate identical components.

Figure 18:
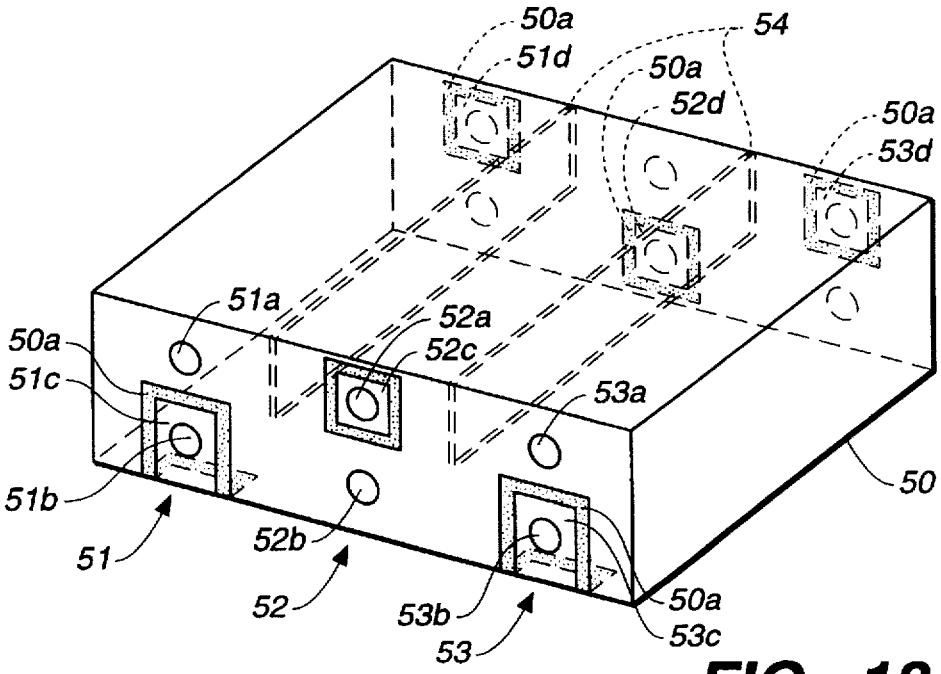
FIG. 18 is a schematic diagonal view of a three-stage dielectric BEF according to an eighth embodiment of this invention.

FIG. 18 shows a three-stage interdigitally coupled dielectric BEF according to an eighth embodiment of this invention, comprising a rectangular dielectric block 50 having a total of six circular cylindrical throughholes formed therethrough near one another from one end surface to the opposite end surface of the block 50, arranged geometrically in two horizontal rows, resonant lines 51*a*, 52*a* and 53*a* being formed in the throughholes of the upper row and resonant lines 51*b*, 52*b* and 53*b* being formed in the throughholes of the lower row. Inner conductors are formed on the inner surfaces of these throughholes for the resonant lines 51*a*–53*a*, 51*b*–53*b*. The inner conductors of the resonant lines 51*b*, 52*a*, 53*b* are connected respectively to electrodes 51*c*, 52*c*, 53*c* on one of the end surfaces (first end surface) of the block 50 and to an outer conductor on the other end surface (second end surface). The inner conductors of the resonant lines 51*a*, 52*b*, 53*a* are connected respectively to electrodes 51*d*, 52*d*, 53*d* on the second end surface and to the outer conductor on the first end surface. The outer conductor covers the outer surfaces of the dielectric block 50 substantially entirely except conductor-free (or dielectric-exposing) areas 50*a* surrounding the electrodes 51*c*–53*c*, 51*d*–53*d*.

Figure 19:
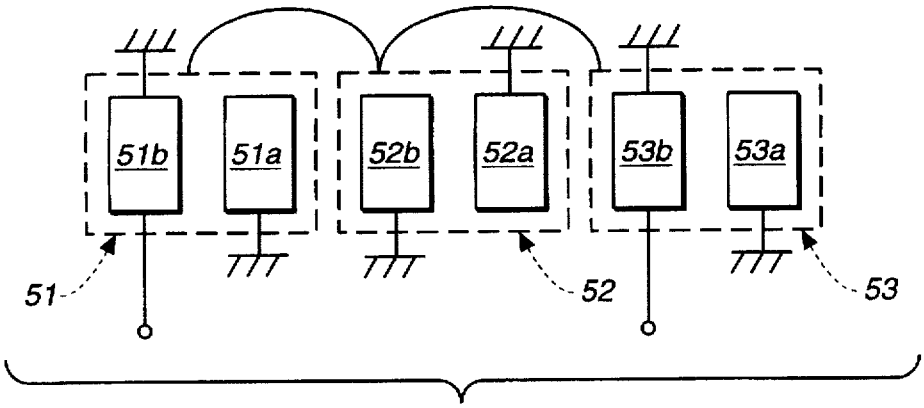
FIG. 19 is a circuit structure diagram of the filter of FIG. 18.
Figure 20:
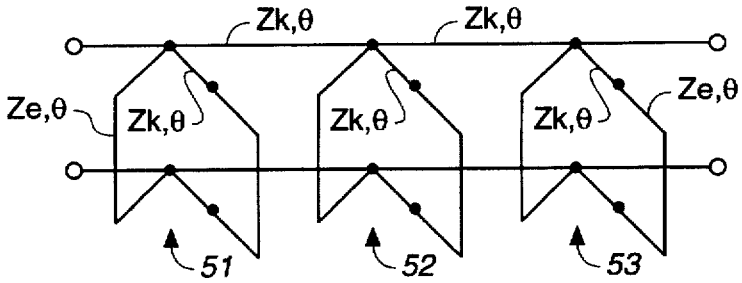
FIG. 20 is an equivalent circuit diagram of the filter of FIG. 18.

Screening electrodes 54 are provided between horizontally adjacent pairs of resonant lines of the upper row 51*a* with 52*a*, 52*a* with 53*a* for preventing coupling therebetween. Each pair of vertically adjacent resonant lines 51*a* with 51*b*, 52*a* with 53*b*, 53*a* with 53*b* of the upper and lower rows is interdigitally coupled to form single-stage BEFs 51, 52, 53. Mutually adjacent pairs of the resonant lines of the lower row 51*b* with 52*b*, 52*b* with 53*b* are interdigitally coupled with phase shift of Π/2 such that the three single-stage BEFs 51, 52, 53 together form an interdigitally coupled dielectric BEF. FIG. 19 is its circuit structure diagram, and FIG. 20 is its equivalent circuit diagram. Explanations given above for FIGS. 15 and 16 should be referenced also for FIGS. 19 and 20.

Figure 21:
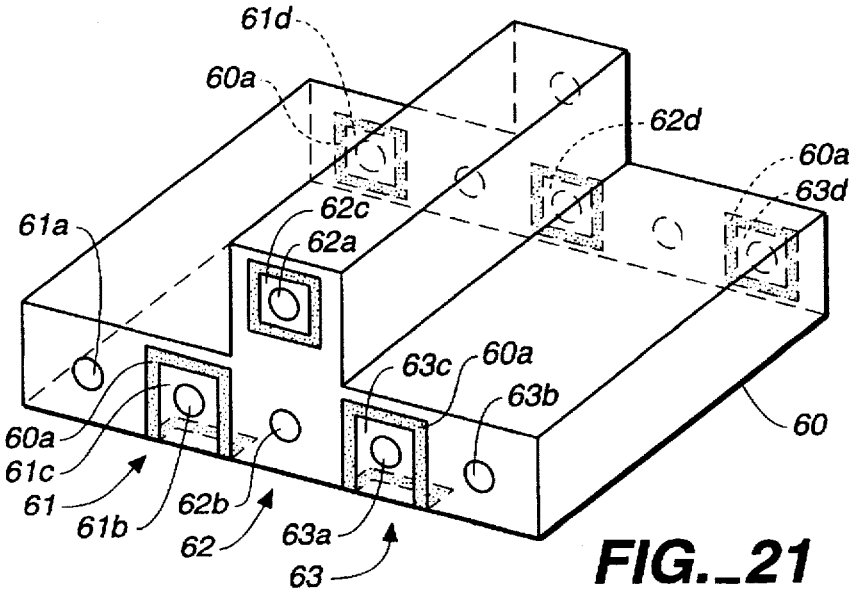
FIG. 21 is a schematic diagonal view of another three-stage dielectric BEF according to a ninth embodiment of this invention.

FIG. 21 shows another three-stage interdigitally coupled dielectric BEF according to a ninth embodiment of this invention, comprising a rectangular dielectric block 60 having a protrusion and a total of six throughholes formed therethrough with inner conductors formed on the inner surfaces of these throughholes so as to provide six resonant lines 61*a*, 62*a*, 63*a*, 61*b*, 62*b* and 63*b* near one another. Resonant lines 62*a* and 62*b* are vertically adjacent to each other and interdigitally coupled to each other to together form a single-stage BEF 62. Pairs of resonant lines 61*a* with 61*b*, 63*a* with 63*b* are horizontally adjacent and interdigitally coupled to each other to form single-stage BEFs 61 and 63, respectively. The inner conductors of the resonant lines 61*b*, 62*a*, 63*a* are connected respectively to electrodes 61*c*, 62*c*, 63*c* on one end surface (first end surface) of the dielectric block 60 and to an outer conductor on the opposite end surface (second end surface). The inner conductors of resonant lines 61*a*, 62*b*, 63*b* are connected respectively to electrodes 61*d*, 62*d*, 63*d* on the second end surface and to the outer conductor on the first end surface. The outer conductor covers the outer surfaces of the dielectric block 60 substantially entirely except at conductor-free (or dielectric-exposing) areas 60*a* around the electrodes 61*c*–63*c*, 61*d*–63*d*. The three single-stage BEFs 61, 62, 63 are interdigitally coupled with phase shift of Π/2 as in the preceding embodiment of the invention, forming an interdigitally coupled dielectric BEF. The circuit structure diagram and the equivalent circuit diagram of this filter are substantially the same as shown in FIGS. 19 and 20.

Figure 22:
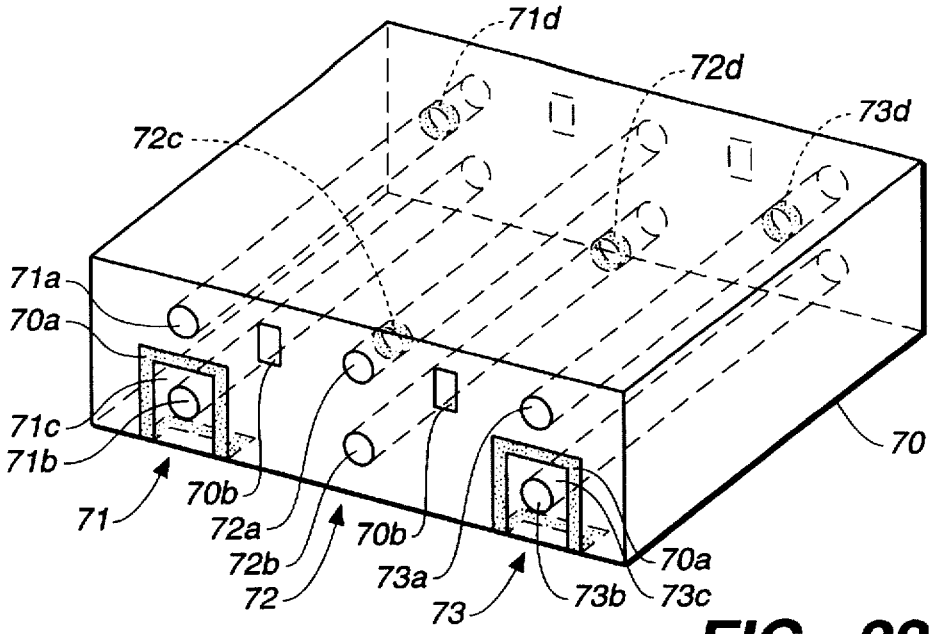
FIG. 22 is a schematic diagonal view of still another three-stage dielectric BEF according to a tenth embodiment of this invention.

FIG. 22 shows still another three-stage interdigitally coupled dielectric BEF according to a tenth embodiment of this invention, comprising a rectangular dielectric block 70 having a total of six resonator-forming throughholes formed therethrough from one end surface to the opposite end surface of the block 70, arranged geometrically near one another so as to provide three circular cylindrical resonant lines 71*a*, 72*a* and 73*a* on an upper row and three others 71*b*, 72*b* and 73*b* on an lower row. Inner conductors are formed on the inner surfaces of these resonator-forming throughholes.

The inner conductors of the resonant lines 71*b*, 73*b* are respectively connected to electrodes 71*c*, 73*c* on one of the end surfaces (first end surface) of the dielectric block 70. Both ends of the inner conductors of the resonant lines 71*a*–73*a*, 71*b*–73*b* are connected to an outer conductor except at the ends of the resonant lines 71*b*, 73*b* on the first end surface. The outer conductor covers the outer surfaces of the dielectric block 70 substantially entirely except at conductor-free (or dielectric-exposing) areas 70*a* surrounding the electrodes 71*c*, 73*c*.

The resonant lines 71*a*, 72*b*, 73*a* are respectively provided with annular conductor-free (or dielectric-exposing) areas 71*d*, 72*d*, 73*d* near the opposite end surface (second end surface) of the dielectric block 70. The resonant line 72*a* is similarly provided with an annular conductor-free (or dielectric-exposing) area 72*c* near the first end surface of the dielectric block 70. These annular areas 71*d*–73*d*, 72*c* serve not only to divide the corresponding inner conductors into two parts but also as open ends of the corresponding resonant lines. Although not separately illustrated, these annular areas 71*d*–73*d*, 72*c* may each be formed adjacent to (rather than near) the first or second end surface.

Screening throughholes 70*b* are formed through the dielectric block 70 parallel to the aforementioned resonator-forming throughholes between the resonant lines 71*a* and 72*a* and also between the resonant lines 72*a* and 73*a* on the upper row. These screening throughholes 70*b* contain screening electrodes therein, in contact with the outer conductor at both ends so as to prevent coupling between the resonant lines 71*a* and 72*a* and between the resonant lines 72*a* and 73*a*. The vertically adjacent pairs of resonant lines 71*a* with 71*b*, 72*a* with 72*b*, 73*a* with 73*b* are interdigitally coupled to each other to form three single-stage BEFs 71, 72, 73. The mutually adjacent pairs of resonant lines on the lower row 71*b* with 72*b*, 72*b* with 73*b* are each interdigitally coupled with phase shift of Π/2 such that the three single-stage BEFs 71, 72, 73 together form an interdigitally coupled dielectric BEF. FIG. 19 shows its circuit structure diagram, and FIG. 20 shows its equivalent circuit diagram.

Figure 23:
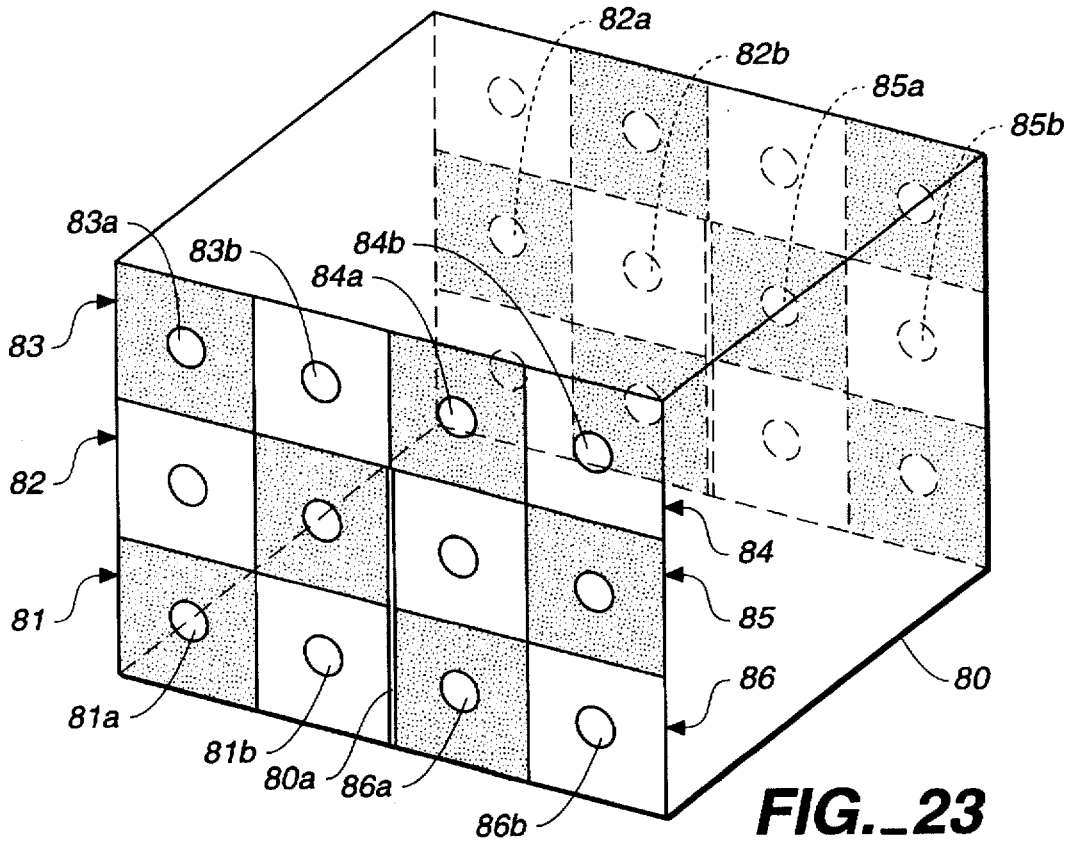
FIG. 23 is a schematic diagonal view of a six-stage dielectric BEF according to an eleventh embodiment of this invention.

FIG. 23 shows a six-stage interdigitally coupled BEF according to an eleventh embodiment of this invention, comprising a rectangular dielectric block 80 having a total of twelve circular cylindrical throughholes formed from one end surface to the opposite end surface of the dielectric block 80, geometrically arranged in three horizontal rows and four vertical columns, having inner conductors formed on the inner surfaces of the throughholes so as to serve as resonant lines 81*a*, 82*a*, 83*a*, 84*a*, 85*a*, 86*a*, 81*b*, 82*b*, 83*b*, 84*b*, 85*b* and 86*b*. Resonant lines 81*a*, 82*b*, 83*a*, 84*a*, 85*b*, 86*a* each have an open end on one of the end surfaces (first end surface) of the dielectric block 80 and a shorted end on the opposite end surface (second end surface) of the dielectric block 80. Resonant lines 81*b*, 82*a*, 83*b*, 84*b*, 85*a*, 86*b* each have a shorted end on the first end surface and an open end on the second end surface. The outer surfaces of the dielectric block 80 are substantially entirely covered by an outer conductor except at the aforementioned open ends. Screening electrodes 80*a* connected to the outer conductor are provided between mutually adjacent pair of resonant lines 81*b* and 86*a* of the lower row and between mutually adjacent pair of resonant lines 82*b* and 85*a* of the middle row. Horizontally adjacent pairs of resonant lines 81*a* and 81*b*, 82*a* and 82*b*, 83*a* and 83*b*, 84*a* and 84*b*, 85*a* and 85*b*, 86*a* and 86*b* couple to each other interdigitally within themselves to form single-stage BEFs 81, 82, 83, 84, 85, 86, respectively. Mutually adjacent pairs of these single-stage BEFs 81–86 couple interdigitally each other with phase shifts of Π/2 and thereby form altogether an interdigitally coupled dielectric BEF. Input to and output from this filter are effected through the resonant lines 81*b* and 86*a*.

Figure 24:
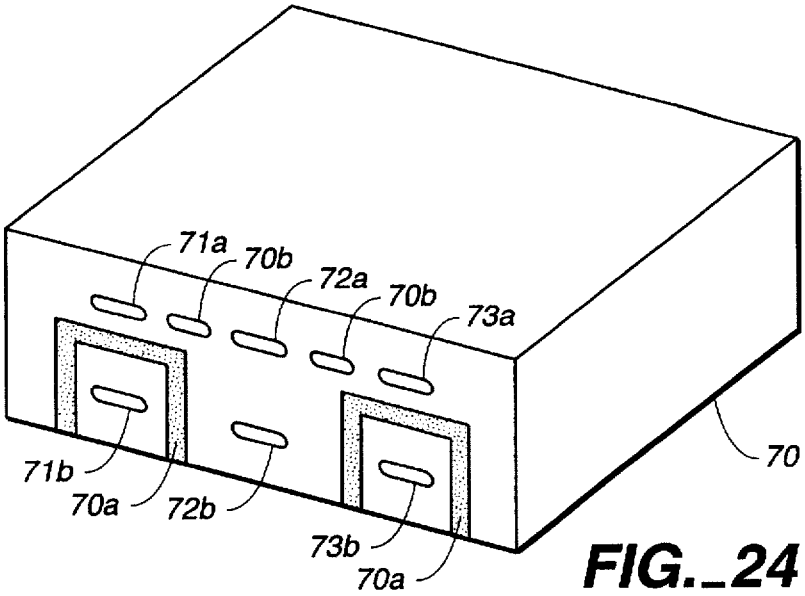
FIG. 24 is a schematic diagonal view of a three-stage dielectric BEF according to a variation of the tenth embodiment of this invention.
Figure 25:
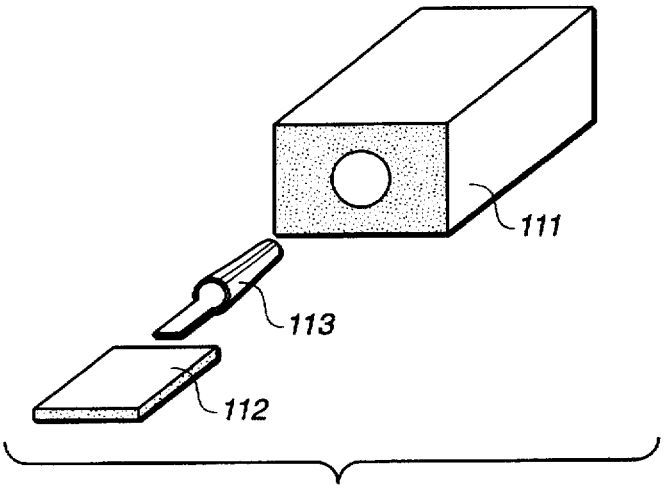
FIG. 25 (PRIOR ART)
FIG. 25 is an exploded diagonal view of a prior art single-stage dielectric BEF.
Figure 26:
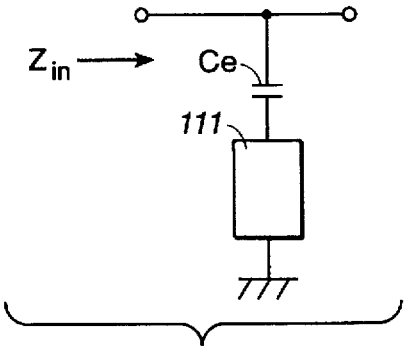
FIG. 26 (PRIOR ART)
FIG. 26 is a circuit structure diagram of the prior art filter of FIG. 25.

Although the present invention has been described above with reference to only a limited number of examples, these examples are not intended to limit the scope of the invention. Many modifications and variations are possible within the scope of this invention. For example, throughholes, whether for forming resonant lines therein or for containing a screening electrode, need not be circular in cross-section. If the throughholes are made in the shape of a horizontally elongated rectangle of flattened ellipse, the filter as a whole can be made thinner. FIG. 24, for example, shows a variation of the filter according to the tenth embodiment of this invention shown above in FIG. 22, having all its throughholes formed in an elliptical shape. Since the filters shown in FIGS. 22 and 24 are different only in the cross-sectional shapes of their throughholes and are identical in all other aspects, same numerals are used to indicate corresponding components. In all examples, furthermore, it is to be understood that input and output connections can be formed in any known manners.

In summary, sufficient attenuation can be obtained both on the lower and higher frequency sides of the trap frequency by a dielectric BEF according to this invention. If such a filter is used in a mobile communication apparatus such as a portable telephone, it is possible to simplify the circuit structure by eliminating the isolator and the BPF which used to be necessary. Since the number of component parts becomes reduced, the production cost is also reduced. If the number of components to be soldered is reduced, reliability is improved, individual variations in characteristics are reduced among the products, and the yield is increased.

What is claimed is:

1. A dielectric band elimination filter comprising:

a dielectric block having outer surfaces including two mutually opposite end surfaces;

an outer conductor covering portions of said outer surfaces; and two mutually coupled resonant lines extending in said dielectric block between said end surfaces, each of said resonant lines having a respective open end which is not in contact with said outer conductor and a respective shorted end which is in contact with said outer conductor, said open and shorted ends of said two resonant lines being oppositely oriented, the open end of one of said resonant lines being connected to a communication line connected between an input terminal and an output terminal, the shorted end of the other of said resonant lines being grounded.

2. The dielectric filter of claim 1 wherein one of said end surfaces has a conductor-free area and said open end of one of said resonant lines is at said conductor-free area.

3. The dielectric filter of claim 1 wherein said respective open ends of said resonant lines are connected to corresponding end surfaces, said respective end surface electrodes are provided on said end surfaces and are insulated from said outer conductor.

4. The dielectric filter of claim 1 wherein said dielectric block has throughholes therethrough as parts of said resonant lines between said end surfaces and said respective open ends are at conductor-free areas on inner surfaces of said corresponding throughholes.

5. A dielectric filter comprising:

a dielectric block having outer surfaces including mutually opposite first and second end surfaces;

a plurality of single-stage band elimination filters each having two interdigitally coupled resonant lines extending between said first and second end surfaces inside respective throughholes extending through said block, each mutually adjacent pair of said plurality of single-stage band elimination filters being coupled to each other in either of two modes selected from the group constituting interdigital coupling and comblinecoupling; and an outer conductor covering portions of said outer surfaces of said dielectric block, said resonant lines being arranged in two horizontal rows consisting of upper and lower rows and at least three vertical columns including end columns and inner columns therebetween, each of said resonant lines having a respective open end and a respective shorted end, the respective pair of the resonant lines in each column being interdigitally coupled to each other to provide a corresponding single-stage band elimination filter, the open and shorted ends of the interdigitally coupled pair of each of said single-stage band elimination filter being provided at opposite ones of said end surfaces, the open ends of the resonant lines in said end columns on said lower row being each connected to a corresponding open end terminal provided on one of said end surfaces of said dielectric block, the open ends of the resonant lines in said end columns on said upper row and in said inner columns being each provided at a respective annular conductor-free area provided on inner surface of corresponding one of said throughhole.

6. The dielectric filter of claim 5 wherein said rows extend horizontally, and said throughholes each have a horizontally elongated cross-sectional shape.

7. A dielectric filter comprising:

a dielectric block having outer surfaces including mutually opposite first and second end surfaces;

a plurality of single-stage band elimination filters each having two interdigitally coupled resonant lines extending between said first and second end surfaces inside respective throughholes extending through said block, each mutually adjacent pair of said plurality of single-stage band elimination filters being coupled to each other in either of two modes selected from the group constituting interdigital coupling and comblinecoupling, one of said single-stage band elimination filters being connected to an input line, another of said single-stage band elimination filter being connected to an output line; and an outer conductor which covers portions of said outer surfaces of said dielectric block, each of said two interdigitally coupled resonant lines having a respective open end which is insulated from said outer conductor and a respective shorted end which is connected to said outer conductor, said open and shorted ends of said two resonant lines of each of said plurality of single-stage band elimination filters being oppositely oriented, the open end of one of said two resonant lines of each of said plurality of single-stage band elimination filters being provided at one of said end surfaces, the open end of the other of said two resonant lines of each of said plurality of single-stage band elimination filters being at an annular conductor-free area provided on a respective inner surface of a corresponding one of said throughholes.

8. A dielectric filter comprising:

a dielectric block having outer surfaces including mutually opposite first and second end surfaces;

a plurality of single-stage band elimination filters each having two interdigitally coupled resonant lines extending between said first and second end surfaces inside respective throughholes extending through said block, each mutually adjacent pair of said plurality of single-stage band elimination filters being coupled to each other in either of two modes selected from the group constituting interdigital coupling and comblinecoupling; and an outer conductor which covers portions of said outer surfaces of said dielectric block, each of said two interdigitally coupled resonant lines having a respective open end which is insulated from said outer conductor and a respective shorted end which is connected to said outer conductor, said open and shorted ends of said two resonant lines of each of said plurality of single-stage band elimination filters being oppositely oriented, the open end of one of said two resonant lines of each of said plurality of single-stage band elimination filters being provided at one of said end surfaces, the open end of the other of said two resonant lines of each of said plurality of single-stage band elimination filters being at an annular conductor-free area provided on a respective inner surface of a corresponding one of said throughholes wherein said respective throughholes are horizontally extending and horizontally arranged and have a horizontally elongated cross-sectional shape.

9. A dielectric filter comprising:

a dielectric block having outer surfaces including mutually opposite first and second end surfaces; and a plurality of single-stage band elimination filters each having two interdigitally coupled resonant lines extending between said first and second end surfaces inside respective throughholes extending through said block, each mutually adjacent pair of said plurality of single-stage band elimination filters being comb-line coupled to each other; and an outer conductor covering portions of said outer surfaces of said dielectric block, said resonant lines being arranged in two horizontal rows consisting of upper and lower rows and at least two vertical columns, each of said resonant lines having a respective open end which is insulated from said outer conductor and a respective shorted end which is connected to said outer conductor, the open and shorted ends of each one of the resonant lines on said upper row being provided respectively at said first and second end surfaces, the open and shorted ends of each one of the resonant lines on said lower row being provided respectively at said second and first end surface, the respective pair of the resonant lines in each column being interdigitally coupled to each other to provide a corresponding single-stage band elimination filter.

10. The dielectric filter of claim 9 wherein said throughholes each have a horizontally elongated cross-sectional shape.

11. A dielectric filter comprising:

a dielectric block having outer surfaces including mutually opposite first and second end surfaces;

a plurality of single-stage band elimination filters each having two interdigitally coupled resonant lines extending between said first and second end surfaces inside respective throughholes extending through said block, each mutually adjacent pair of said plurality of single-stage band elimination filters being coupled to each other in either of two modes selected from the group constituting interdigital coupling and comblinecoupling; and an outer conductor covering portions of said outer surfaces of said dielectric block, each of said resonant lines having a respective open end which is insulated from said outer conductor and a respective shorted end which is connected to said outer conductor, said resonant lines being arranged in at least three horizontal rows and at least four vertical columns, the open ends of each pair of resonant lines which are next to each other in either of two directions consisting of horizontal and vertical directions being at different ones of said end surfaces, respective screening electrodes being provided between selected pairs of said resonant lines which are next to each other, respective pairs of the resonant lines disposed horizontally next to each other being interdigitally coupled to provide corresponding single-stage band elimination filters.

12. The dielectric filter of claim 11 whereins aid throughholes each have a horizontally elongated cross-sectional shape.

13. A dielectric filter comprising:

a dielectric block having outer surfaces including mutually opposite first and second end surfaces; and a plurality of single-stage band elimination filters each having two interdigitally coupled resonant lines extending between said first and second end surfaces inside respective throughholes extending through said block, each mutually adjacent pair of said plurality of single-stage band elimination filters being interdigitally coupled to each other; and an outer conductor covering portions of said outer surfaces of said dielectric block, said resonant lines being arranged in two horizontal rows consisting of upper and lower rows and at least two vertical columns, each of said resonant lines having a respective open end which is insulated from said outer conductor and a respective shorted end which is connected to said outer conductor, the-open and shorted ends of each one of the resonant lines on said upper row being provided respectively at said first and second end surfaces, the open and shorted ends of each one of the resonant lines on said lower row being provided respectively at said second and first end surface, the respective pair of the resonant lines in each column being interdigitally coupled to each other to provide a corresponding single-stage band elimination filter, a respective screening electrode connected to said outer conductor being provided between each of mutually adjacent pairs of said resonant lines on said upper row.

14. The dielectric filter of claim 13 wherein said throughholes each have a horizontally elongated cross-sectional shape.

15. A dielectric filter comprising:

a dielectric block having outer surfaces including mutually opposite first and second end surfaces;

a plurality of single-stage band elimination filters each having two interdigitally coupled resonant lines extending between said first and second end surfaces inside respective throughholes extending through said block, each mutually adjacent pair of said plurality of single-stage band elimination filters being coupled to each other in either of two modes selected from the group constituting interdigital coupling and comblinecoupling; and an outer conductor covering portions of said outer surfaces of said dielectric block, each of said resonant lines having a respective open end which is connected to a corresponding open end electrode insulated from said outer conductor and a respective shorted end which is connected to said outer conductor, said resonant lines being arranged in two horizontal rows consisting of upper and lower rows and at least two vertical columns, the open ends of each pair of resonant lines which are next to each other in either of two directions consisting of horizontal and vertical directions being at different ones of said end surfaces, the respective pair of the resonant lines in each column being interdigitally coupled to each other to provide a corresponding single-stage band elimination filter, a respective screening electrode connected to said outer conductor being provided between each of mutually adjacent pairs of said resonant lines on said upper row.

16. The dielectric filter of claim 15 wherein said throughholes each have a horizontally elongated cross-sectional shape.

17. A dielectric filter comprising: a dielectric block having outer surfaces including mutually opposite first and second end surfaces;

at least three single-stage band elimination filters each having two interdigitally coupled resonant lines extending between said first and second end surfaces inside respective throughholes extending through said block, each mutually adjacent pair of said plurality of single-stage band elimination filters being coupled to each other in either of two modes selected from the group constituting interdigital coupling and comblinecoupling; and an outer conductor covering portions of said outer surfaces of said dielectric block, said dielectric block also having a horizontally extending bottom part and an upwardly protruding central part, each of said resonant lines having a respective open end which is insulated from said outer conductor and a respective shorted end which is connected to said outer conductor, the open and shorted ends of the resonant lines of each of said pairs being at different ones of said end surfaces, one of said pairs being vertically arranged, having one of said resonant lines in said upwardly protruding central part and the other of said resonant lines therebelow, two others of said pairs being horizontally arranged and provided on both sides of said vertically arranged pair in said horizontally extending part of said dielectric block.

18. The dielectric filter of claim 17 wherein said throughholes each have a horizontally elongated cross-sectional shape.

* * * * *